US006955273B2

(12) United States Patent
Hartwall

(10) Patent No.: US 6,955,273 B2
(45) Date of Patent: Oct. 18, 2005

(54) COLLAPSIBLE BULK CONTAINER

(75) Inventor: Peter Hartwall, Perstorp (SE)

(73) Assignee: Arca Systems AB, Perstorp (SE)

( * ) Notice: Subject to any disclaimer, the term of this patent is extended or adjusted under 35 U.S.C. 154(b) by 0 days.

(21) Appl. No.: 10/168,978

(22) PCT Filed: Dec. 19, 2000

(86) PCT No.: PCT/SE00/02574

§ 371 (c)(1),
(2), (4) Date: Jul. 16, 2002

(87) PCT Pub. No.: WO01/47780

PCT Pub. Date: Jul. 5, 2001

(65) Prior Publication Data

US 2003/0102309 A1 Jun. 5, 2003

(30) Foreign Application Priority Data

Dec. 28, 1999 (SE) ..... 9904795

(51) Int. Cl.[7] ..... B65D 88/00; B65D 25/14

(52) U.S. Cl. ..... 220/1.6; 220/495.01; 220/495.06

(58) Field of Search ..... 220/1.6, 495.01, 220/495.06, 7, 6, 4.28, 905, 900, 495.05, 562, 23.89, 592.23, 592.24, 917; 206/600, 508, 594, 523; 217/15, 47; 108/53.1; 222/105

(56) References Cited

U.S. PATENT DOCUMENTS 2,720,998 A * 10/1955 Potter ..... 220/6
2,952,379 A * 9/1960 Pottier ..... 220/6
3,616,943 A * 11/1971 Brink ..... 206/508
4,005,795 A * 2/1977 Mikkelsen et al. ..... 220/7
4,042,111 A * 8/1977 Smith ..... 206/508
5,193,710 A 3/1993 Podd, Sr. et al.
5,343,814 A * 9/1994 Pigott et al. ..... 108/56.1
5,351,846 A * 10/1994 Carter ..... 220/6
5,425,910 A * 6/1995 Wheeler ..... 264/108
5,467,885 A * 11/1995 Blinstrub ..... 220/6
5,507,405 A * 4/1996 Thomas et al. ..... 220/1.5
5,564,599 A * 10/1996 Barber et al. ..... 222/105
5,586,675 A * 12/1996 Borsboom et al. ..... 220/6
5,711,444 A * 1/1998 Meacham et al. ..... 220/6
5,788,103 A * 8/1998 Wagner et al. ..... 220/6
5,979,685 A * 11/1999 Schhutz ..... 220/1.6

FOREIGN PATENT DOCUMENTS

SE 9702607 1/1999

* cited by examiner

*Primary Examiner*—Joseph C. Merek
(74) *Attorney, Agent, or Firm*—Stevens, Davis, Miller & Mosher, L.L.P.

(57) ABSTRACT

Collapsible container, preferably a collapsible bulk container, for the transport and storage of fluent and particle bulk goods. The bulk container includes a carrying base member which is provided with skids, collapsible side walls, preferably a so called liner in the form of a bag shaped inner layer and a lid. The side walls are moveably attached to the base member via hinges and that adjacent side walls are joinable. The lid is provided with one or more profiles, which profiles are intended to exert pressure on a part of the upper side of a filled liner, whereby the possibility for the liner to move in relation to the collapsible container during transport is reduced.

23 Claims, 3 Drawing Sheets

COLLAPSIBLE BULK CONTAINER

CROSS REFERENCE TO RELATED APPLICATIONS

This application is a §371 National Phase of International Application No. PCT/SE00/02574, filed Dec. 19, 2000, claiming priority of Swedish Patent Application No. 9904795-3, filed Dec. 28, 1999.

BACKGROUND OF THE INVENTION

1. Field of the Invention

The present invention relates to a collapsible bulk container, which is used together with a so-called liner in the form of a bag shaped inner layer for the transport and storage of liquid, paste and particle goods.

2. Description of the Related Art

Collapsible containers of pallet container type are a popular type of containers due to the considerable reduction of the return transport volume. Collapsible containers are advantageously manufactured of thermoplastic material which gives light and yet sturdy containers with surfaces that are easy to keep clean. Thermoplastic containers do furthermore have the advantage that the tare weight doesn't change which is the case with for example wood containers where the tare weight might double if the wood becomes wet. Further advantages is that thermoplastics doesn't corrode, as everyone knows, which is the case with containers made of-metal such as aluminium and steel. Most thermoplastic materials does furthermore have a good resistance towards chemicals such as for example acids and alkali which not could be said to be the case with wood or metals.

Handling of bulk goods is separated from case goods by the fact that it can be poured, pumped or ladled while case goods most often is picked. Mineral water can serve as an example of the differences between the two types of goods. The mineral water could either be supplied in tanks for pumping and pouring which would be regarded as bulk handling, or in bottles or cans, which would be regarded as case handling. As further examples of substances that can be bulk handled can be mentioned, fluid substances with various viscosity, particles, powders, grain, granulate or paste-like substances. Such substances can be further exemplified as chemicals for industrial use, semifinished and finished products within the food industry, petrochemical products such as oil, fuels and coal as well as plastic granulate.

Sealing problems between the different parts of the collapsible container will inevitably occur when handling powder, smaller particles and fluids. These sealing problems are most easily overcome by using a so-called liner which is placed on the inside of the erected container. This liner is advantageously given the shape of a completely closed bag with the same shape as the inner volume of the container.

The liner is suitably provided with a filling socket at the upper side and an emptying socket at the lower side. The container must of course also be provided with a hole at the lower end making the emptying socket accessible. A further advantage with a liner, besides solving the sealing problems, are that it becomes easy to meet high hygienic demands.

When handling fluid and particle goods the liner will be exposed to forces, often hard to predict, especially at acceleration, retardation and bumps. These forces will cause abrasion on the liner which can cause the liner to rupture so that the content will leak. This will of course cause some inconveniences but can also be hazardous if the container is used for transporting dangerous goods.

SUMMARY OF THE INVENTION

The above mentioned problems has, through the present invention, been solved whereby the risk for leakage when using a collapsible bulk container with a liner has been considerably reduced. Accordingly, the invention relates to a collapsible bulk container for the transport and storage of liquid and particle bulk goods. The collapsible bulk container includes a supporting base member which is provided with pallet skids, collapsible side walls, preferably a so-called liner in the form of a bag-shaped inner layer and a lid. The side walls are moveably attached to the base member via hinges. Adjacent side walls are furthermore joinable. The invention is characterised in that the lid is provided with one or more profiles, which profiles are intended to exert pressure on a part of the upper side of a liner. The possibility for the line to move, in relation to the container, during transport will hereby be reduced.

The collapsible bulk container is furthermore suitably provided with three parallel skids of which two are placed at one edge each while the third is placed at the middle of the bottom of the collapsible bulk container. One of the profiles of the lid is hereby arranged so that a possible warping of a centrally placed skid on a collapsible bulk container placed straight on top of such a lid of a second collapsible bulk container, is allowed to occupy the space in said profile.

According to a special embodiment of the invention, the collapsible bulk container is provided with three longitudinal parallel skids of which two are placed at each of the long side edges while the third is placed at the middle of the bottom of the collapsible bulk container.

The collapsible container is furthermore provided with three parallel latitudinal skids, of which two are applied at each of the two short side edges while the third is placed in the middle of the bottom of the collapsible bulk container. Two of the profiles of the lid are hereby arranged so that a possible warping of a centrally placed skids on a collapsible bulk container placed straight on top of such a lid of a second collapsible bulk container, is allowed to occupy the space in said profiles.

At least two opposite walls are according to one embodiment of the invention provided with one or more profiles placed on the inside. The profiles are intended to exercise a guiding influence on the sides of a filled liner. The possibility for the liner to move relative the collapsible bulk container is hereby reduced further The side walls of the collapsible bulk container are suitably constituted by an inner an outer layer between which one continuous or several separated hollow spaces are arranged. One or more reinforcing beams are suitably arranged in the hollow space or in one or more of the hollow spaces. Such a reinforcing beam may be made of metal, such as aluminium or steel, but may also be made of a thermoplastic material, such as a polyolefin or polyamide which possibly is filled with a reinforcing material such as glass fibre, carbon fibre or aramide fibre. It is also possible to use wood as a reinforcement in the hollow space or hollow spaces. The hollow spaces can also be filled with polymeric foam with an average density in the range 50–500 kg/m$^3$, which foam for example is constituted of polyurethane or a polyolefine. The filling with foam may be a complement to reinforcing beams as well as an alternative thereto.

Side walls according to selected embodiments of the invention can be achieved by injection moulding the inner and outer layer separately from a thermoplastic material The layers are joined to each other after the injection moulding through means of welding, screws, rivets or snap joining.

The inner and outer layers may alternatively be manufactured by vacuum moulding sheet shaped thermoplastic work pieces, which layers are joined together while the material is still hot. It is also possible to manufacture the inner and outer sheets as a simultaneous whole through blow moulding of a thermoplastic material. It is possible to achieve side walls with mainly plane outer surfaces through the described process.

Collapsible container according to above are preferably manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene-copolymer, polyamide, polycarbonate or the like. They are suitably manufactured through injection moulding, vacuum moulding, blow moulding or combinations thereof. Since the desired material characteristics of the different parts that the container is made up of can vary from part to part it is possible to add different additives to the thermoplastic material that will make this possible. As examples of such known additives can be mentioned ethylene-vinyl-acetate and rubber beads which will make the material more ductile and more impact resistant or glass fibre, carbon fibre, steel fibre or aramide fibre which will make the material more rigid but on the other hand more brittle.

The collapsible container can also be provided with a device for heating. Such a device can for example be constituted by plates arranged on the base and/or sides of the container. The heating device is suitably supplied with electrical energy but can also be constituted by tubes with a heated circulating fluid or gas. Such a heating device is used when the content of the container is solid or highly viscous at normal room temperature. As an example of such possible contents can be mentioned chocolate, certain vegetable oils, certain waxes and resins.

A heating device supplied with electrical energy can for example be constituted by a thermoplastic material filled 20–70% of an electrically conductive filler such as graphite nodules, carbon fibre, steel fibre or the like. The thermoplastic material is suitably constituted by materials such as polyethylene, polypropylene, polybutene, polyamide, polycarbonate, polyalkylene-therephtalate, polyvinylchloride or the like. The thermoplastic/filler mixture is suitably given the shape of plates which are connected to a electrical conductor so that a current will flow through the plate which then will serve as a heating element. Such plates can also be integrated with the different parts of the container. It is possible to avoid some known disadvantages with this type of heating element by integrating it with the container. The foremost disadvantage is that graphite, that is the material most suited for use in this type of heaters, normally smears rather heavily. It is of course possible to use a liner on such heaters with for example a thermoplastic foil to avoid smearing when dismountable heaters are desired.

The graphite nodules, carbon fibres etc. will, due to the thermal expansion in the thermoplastic material, be separated from each other when the temperature rises.

The electrical resistance in the heater will therefore also rise which will make the heater self guiding. The need of any guiding electronics can hereby be decreased or completely avoided. It is possible to achieve different temperature ranges by increasing or decreasing the filler content. It is hereby also possible to adapt the heater to the voltage supply that is at hand, for example 12 or 24 V in vehicles.

The liner is preferably folded in a special pattern before filling, which special pattern allows it to unfold automatically to the desired shape when being filed. The unfilled liner is suitably given the form of a cassette with a filling socket placed easy to reach at the top of the cassette. The cassette is installed on one of the side walls by means of a guiding and holding cassette holder.

The lid is, according to one embodiment of the invention, provided with guiding means which are intended to co-operate with guiding agents arranged on the under side of the skids. The guiding means and the guiding agents are arranged on such relative positions that these coincides when a first collapsible bulk container are placed on top of a second collapsible bulk container so that they coincides vertically. A number of first bulk containers can also be placed overlapping on top of a number of second bulk containers so that the upper collapsible bulk container or containers rest with mainly equal parts on two of the underlying collapsible bulk containers. The stacking stability is hereby increased.

The guiding means and the guiding agents are hereby suitably arranged in groups of four or more whereby the mutual position between upper and lower collapsible bulk containers can be changed in steps of at least 5 mm whereby a stack of collapsible bulk containers are allowed to deviate from the vertical model axis with a maintained stability of the stack. The guiding means suitably constitutes an integrated part of the lid while the guiding agents constitutes an integrated part of the respective skid.

The invention is described further in connection to enclosed figures showing different embodiments of the invention whereby,

DETAILED DESCRIPTION OF THE PREFERRED EMBODIMENTS

Figure 1:
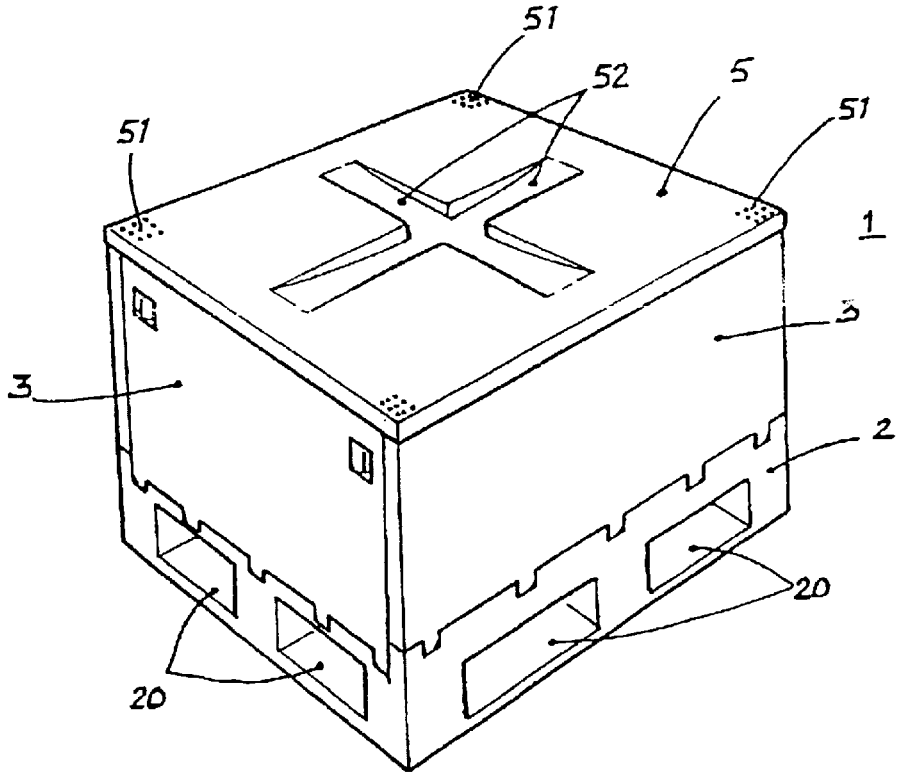
FIG. 1 shows, in perspective view seen aslant from above, an embodiment of a collapsible bulk container 1 according to the invention.
Figure 2:
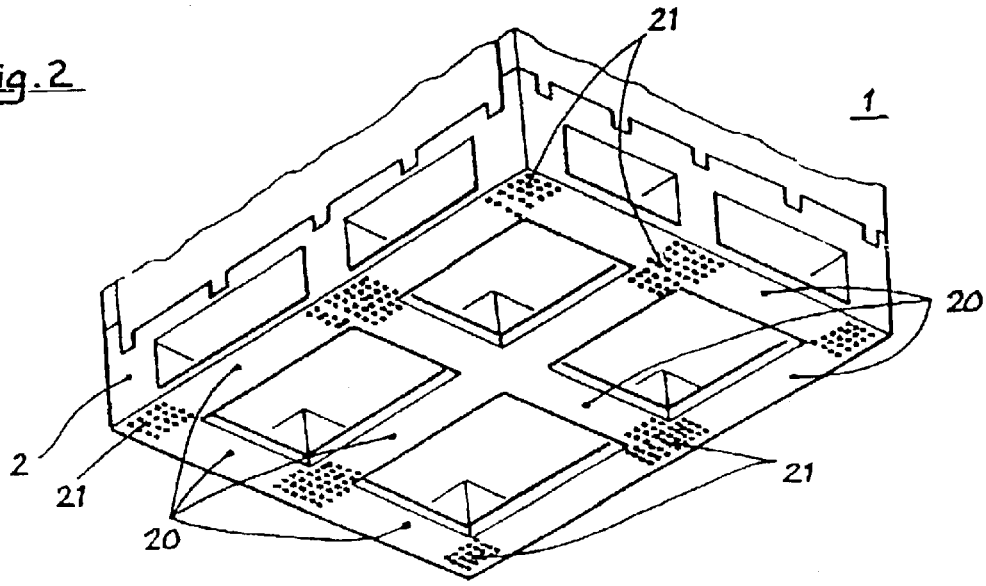
FIG. 2 shows parts of the embodiment of a collapsible bulk container from FIG. 1 seen aslant from below.

Accordingly, FIG. 1 shows in perspective view seen aslant from above an embodiment of collapsible bulk container 1 according to the invention, while FIG. 2 shows in perspective view seen aslant from below parts of the same embodiment. The collapsible bulk container 1 is used for transport and storage of fluent and particle bulk goods. The bulk container 1 comprises a carrying base member 2 which is provided with skids 20. The bulk container 1 also includes collapsible side walls 3, preferably a so called liner 4 (see FIG. 3) in the form of a bag-shaped inner layer and a lid 5. The side walls 3 are moveably attached to the base member via hinges. It is possible to join adjacent side walls 3. The lid 5 is provided with guiding means 51 which are intended to interact with guiding agents 21 (see FIG. 2) which are arranged on the lower side of the skids 20. The guiding means 51 and the guiding agents 21 are arranged on such a position that a first collapsible bulk container 1 can be placed on top of second collapsible bulk container 1 so that these coincides mainly vertical and that a first collapsible bulk container 1 or a number of first bulk containers 1 can be placed overlapping on a number of second bulk containers 1 so that the upper collapsible bulk containers 1 rests with mainly equal parts on two of the lower collapsible bulk containers 1 whereby a horizontal stacking stability is obtained. The guiding means 51 and the guiding agents 21 are arranged in groups of more than nine whereby the mutual position between the upper and lower collapsible bulk container 1 can be changed horizontally in steps of 6 mm whereby a stack of collapsible bulk containers 1 is allowed to deviate from the vertical ideal axis with maintained stability of the stack. A stabile stacking with overlap can hereby be achieved even if the side walls of bulk containers 1 according to invention is warped outwards due to the content. The guiding means 51 forms a part integrated with the lid 5, while the guiding agents 21 forms a part integrated with respective skid 20. The lid 5 is furthermore provided with profiles 52, which are intended to exert pressure on the upper side of a filled liner 4 whereby the possibility for the liner 4 to move in relation to the collapsible bulk container 1 is reduced. See also FIG. 3. The collapsible bulk container 1 is provided with three longitudinal parallel skids 20 (see FIG. 2) of which two are arranged on each of the two long side edges while the third is arranged in the middle of the bottom of the collapsible bulk container 1. The collapsible bulk container 1 is furthermore provided with three latitudinal parallel skids 20 of which two are arranged at each of the two short side edges while the third is arranged in the middle of the bottom of the collapsible bulk container 1. Two of the profiles 52 (se FIG. 1) of the lid 5 are arranged so that a possible warping of skids 20 arranged in the middle of a collapsible bulk container 1 arranged on top of such a lid 5, is allowed to occupy the space of said profiles 52.

Figure 3:
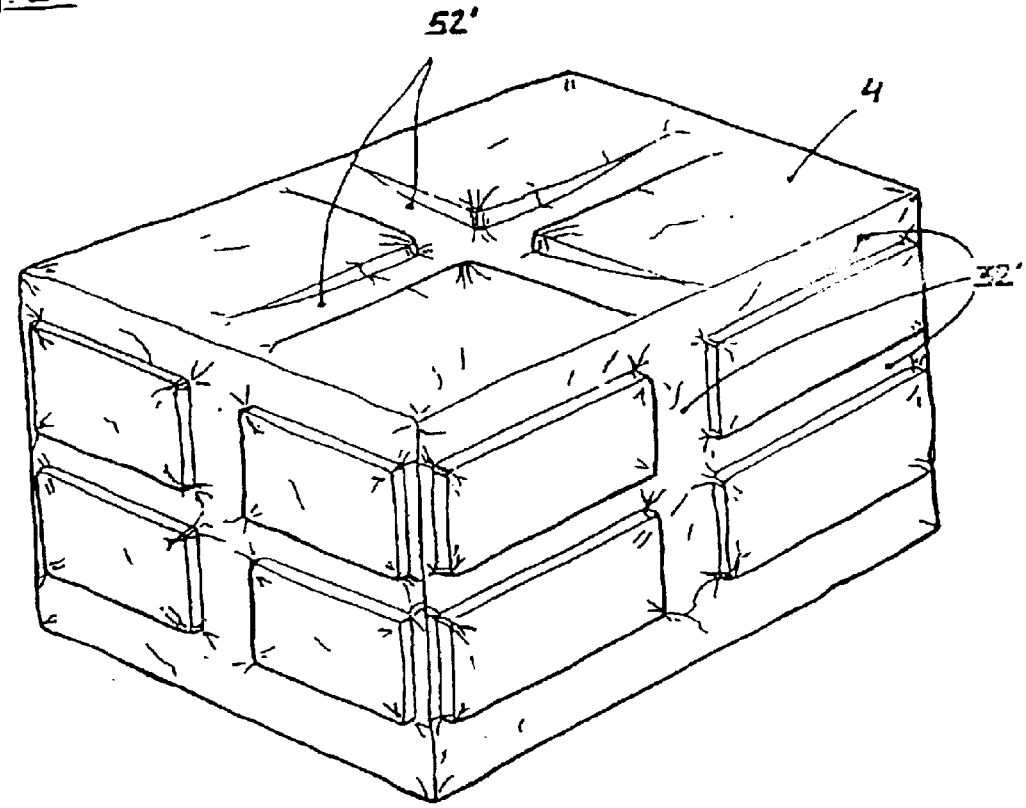
FIG. 3 shows in perspective view seen aslant from above a liner 4 to a collapsible bulk container 1.

FIG. 3 shows in perspective seen aslant from above a liner 4 to a collapsible bulk container 1. The liner is illustrated in the shape it will have when filled inside a collapsible bulk container 1 according o the invention. The lid 5 (see FIG. 1) is provided with two profiles 52 which are intended to exert pressure on a part of the upper side of a filled liner 4, whereby the possibility for the liner to move in relation to the collapsible bulk container l during transport is reduced. The side walls 3 (FIGS. 1 and 4) are provided with several profiles 32 (FIG. 4) arranged on the inside which are intended to have a guiding effect on parts of the sides of a filled liner 4 whereby the possibility for the liner to move in relation to the collapsible bulk container 1 during transport is reduced. The profiles will generate indentations 32' and 52' on sides and top respectively of the liner 4.

Figure 4:
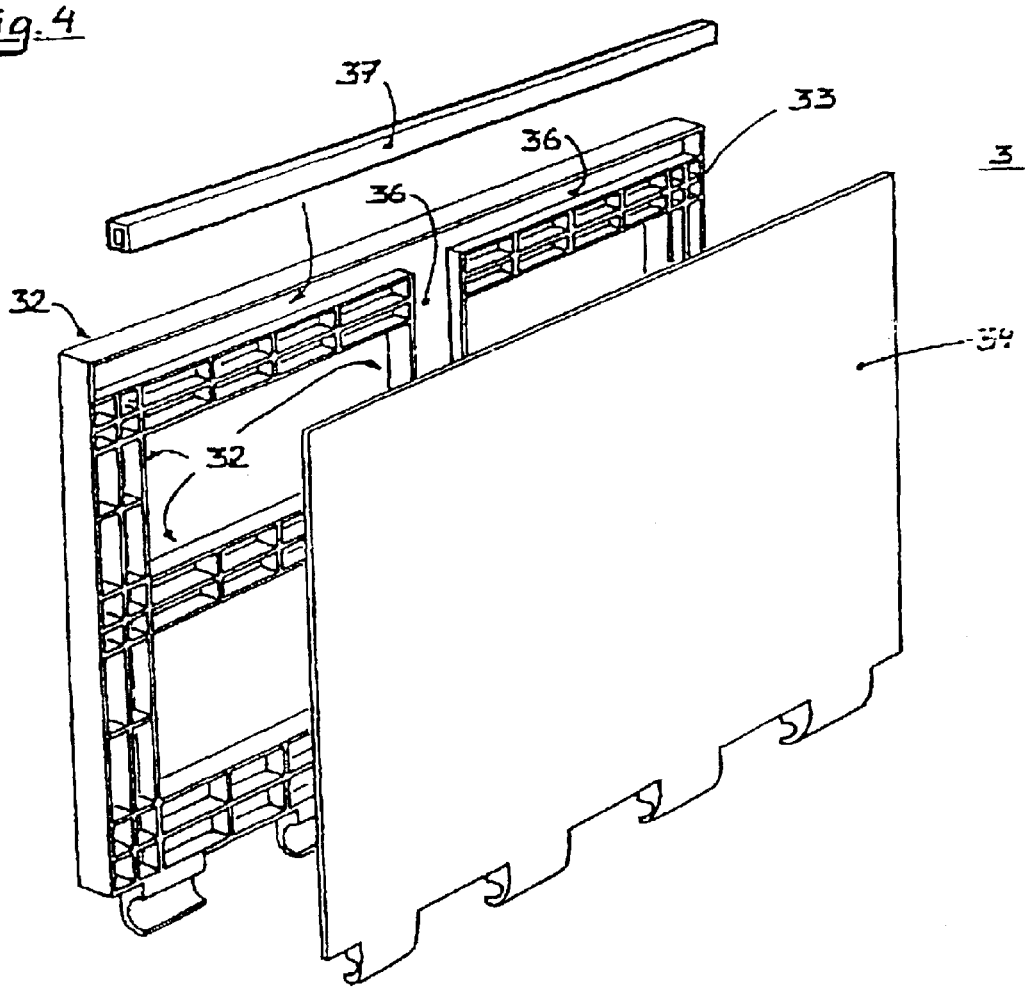
FIG. 4 shows in perspective view, in the form of a blown view, parts to a collapsible side wall 3 to collapsible bulk container 1 according to invention.

FIG. 4 shows in perspective view, in the form of a blown view, parts to a collapsible side wall to a collapsible bulk container 1 (see FIG. 1) according to the invention. The side walls 3 are provided with several profiles 32 arranged on the inside. The profiles are intended to have a guiding effect on parts of the sides of a filled liner 4 (see FIG. 3). The possibility for the liner 4 to move in relation to the collapsible bulk container 1 during transport is reduced. The side walls 3 are constituted of an inner and outer layer 33 and 34 respectively, between which one continuous or several separate hollow spaces 36 are arranged. One or more reinforcing beams 37 may be arranged in one of the hollow spaces 36. Such a reinforcing beam 37 may be made of metal, such as aluminium or steel. It is also possible to utilise a reinforcing beam 37 made of a thermoplastic material, such as a polyolefin or polyamide which is filled with a reinforcing material such as glass fibre, carbon fibre or aramide fibre. It is also possible to use wood as a reinforcement in the hollow space or hollow spaces. The hollow spaces 36 can also be filled with polymeric foam with an average density in the range 50–500 kg/m$^3$, which foam for example is constituted of polyurethane or a polyolefine. Side walls 3 provided with reinforcing beams 37 may of course be filled with foam.

The inner and outer layer 33 and 34 respectively are achieved by injection moulded individually from a thermoplastic material. The layers 33 and 34 respectively are joined to each other after the injection moulding through means of welding. It is also possible to manufacture the inner and outer layers 33 and 34 respectively by vacuum moulding sheet shaped thermoplastic work pieces, which layers 33 and 34 respectively are joined together by being welded while the material is still hot. The inner and outer layers 33 and 34 respectively, may alternatively be manufactured simultaneously through blow moulding of a thermoplastic material. The outer layer 34 of the side walls 3 of a container 1 according to the invention exhibits mainly plane surfaces.

The main parts of a collapsible bulk container 1 according to the invention is advantageously manufactured of one or more polymeric materials such as polyethylene, polypropylene, polybutene, polyvinyl-chloride, polyalkylene-terephtalate, akrylonitrile- butadiene-styrene-copolymer, polyamide, polycarbonate or the like through injection moulding, vacuum moulding or press moulding.

The invention is not limited by the embodiments shown, since these can be altered in several ways within the scope of the invention.

What is claimed is:

1. A collapsible bulk container for the transport and storage of fluent and particulate goods comprising:

a carrying base member which is provided with skids, collapsible side walls to define an inner volume of the container, at least one side wall having at least one depression on an interior surface thereof, a liner in the form of a bag shaped inner layer, said liner having the shane and size of the inner volume, and at least one protrusion of the size and shape of the at least one depression in the interior surface of the side wall, such that when the liner is placed in the container and filled, the protrusion in the liner interfits with the at least one depression and contacts the side wall, and a lid, whereby the side walls are moveably attached to the base member via hinges and that adjacent side walls are joinable, wherein the lid is provided with one or more inwardly directed profiles, which profiles contact the upper surface of the liner, whereby the possibility for the liner to move in relation to the collapsible container during transport is reduced.

2. The collapsible bulk container according to claim 1, wherein the collapsible bulk container is provided with three parallel skids of which two are placed at each of two edges while the third is placed at the middle of the bottom of the collapsible bulk container, that one of the profiles of the lid is arranged so that warping of a centrally placed skid on a collapsible bulk container placed straight on top of such a lid of a second collapsible bulk container, is capable of being received in the space in said profile.

3. The collapsible bulk container according to claim 1, wherein the collapsible bulk container is provided with three longitudinal parallel skids of which two are placed at each of the long side edges while the third is placed at the middle of the bottom of the collapsible bulk container, that the collapsible container furthermore is provided with three parallel latitudinal skids, of which two are applied at each of the two short side edges while the third is placed in the middle of the bottom of the collapsible bulk container, that two of the profiles of the lid are arranged so that a warping of the centrally placed skids on a collapsible bulk container placed straight on top of such a lid of a second collapsible bulk container is capable of being received in the space in said profile.

4. The collapsible bulk container according to claim 1, wherein at least two opposite side walls are provided with one or more depressions, each, arranged on the inside, which depressions are intended to exercise a guiding influence on a part of the sides of a filled liner, whereby the possibility for the liner to move in relation to the collapsible bulk container during transport, is reduced.

5. The collapsible bulk container according to claim 4, wherein the side walls are selected from the group consisting of an inner and an outer layer between which one continuous or several separated hollow spaces are arranged.

6. The collapsible bulk container according to claim 5, wherein at least one reinforcing beam is arranged in the hollow space or one of the hollow spaces.

7. The collapsible bulk container according to claim 6, wherein the reinforcing beam is metal.

8. The collapsible bulk container according to claim 6, wherein the reinforcing beam is a thermoplastic material which optionally is filled with a reinforcing material.

9. The collapsible bulk container according to claim 1, wherein the lid is provided with guiding means which are intended to cooperate with guiding agents arranged on the under side of the skids, which guiding means and guiding agents are arranged on such relative positions that these coincides mainly when a first collapsible bulk container or a number of first collapsible bulk containers are placed overlapping on top of a number of second collapsible bulk container so that the upper collapsible bulk container or containers rest with mainly equal parts on two of the underlying collapsible bulk container whereby a horizontal stacking stability safety is achieved.

10. The collapsible bulk container according to claim 9, wherein the guiding means and the guiding agents are arranged in groups of four or more whereby the mutual position between upper and lower collapsible bulk containers can be changed horizontally in steps of at least 5 mm whereby a stack of collapsible bulk containers are allowed to deviate from the vertical model axis with a maintained stability of the stack.

11. The collapsible bulk container according to claim 9, wherein the guiding means constitutes an integrated part of the lid.

12. The collapsible bulk container according to claim 9, wherein the guiding agents constitutes an integrated part of the respective skid.

13. The collapsible bulk container according to claim 1, wherein the side walls are selected from the group consisting of an inner and an outer layer between which one continuous or several separated hollow spaces are arranged.

14. The collapsible bulk container according to claim 13 wherein the hollow space or the hollow spaces are filled with a polymeric foam with an average density in the range 50–500 kg/m$^3$.

15. The collapsible bulk container according to claim 13, wherein the inner and outer layers are achieved by separately injection mold the inner and outer layer from a thermoplastic material, which layers are joined to each other after the injection molding through means of welding, screws, rivets or snap joining.

16. The collapsible bulk container according to claim 13, wherein the inner and outer layers are manufactured by vacuum molding sheet shaped thermoplastic work pieces, which layers are joined together through welding while the material is still hot.

17. The collapsible bulk container according to claim 13, wherein the inner and outer layers are manufactured through blow molding of a thermoplastic material.

18. The collapsible bulk container according to claim 13, wherein the outer layer of the side walls exhibits mainly plane outer surfaces.

19. The collapsible bulk container according to claim 1, wherein the collapsible bulk container polymeric material is selected from the group consisting of polyethylene, polypropylene, polybutene, polyvinylchloride, polyalkylene-therephtalate, acrylonitrile-butadiene-styrene-copolymer, polyamide, and polycarbonate.

20. The collapsible bulk container according to claim 7, wherein the metal is selected from the group consisting of aluminum and steel.

21. The collapsible bulk container according to claim 8, wherein the reinforcing beam is selected from the group consisting of polyolefin and polyamide.

22. The collapsible bulk container according to claim 6, wherein the reinforcing beam is a thermoplastic material, filled with a reinforcing material, and the reinforcing material is selected from the group consisting of glass fibre, carbon fibre and aramide fibre.

23. The collapsible bulk container according to claim 14, wherein the polymeric foam comprises at least one selected from the group consisting of polyurethane and polyolefin.

* * * * *